US007472631B1

(12) United States Patent
Wu

(10) Patent No.: US 7,472,631 B1
(45) Date of Patent: Jan. 6, 2009

(54) HAND TOOL WITH REPLACEABLE FUNCTION HEAD

(75) Inventor: Arthur Wu, Taichung County (TW)

(73) Assignee: Proxene Tools Co., Ltd., Taichung (TW)

( * ) Notice: Subject to any disclaimer, the term of this patent is extended or adjusted under 35 U.S.C. 154(b) by 11 days.

(21) Appl. No.: 11/907,146

(22) Filed: Oct. 10, 2007

(51) Int. Cl.
*B25B 23/16* (2006.01)

(52) U.S. Cl. ..... 81/177.9; 81/177.8

(58) Field of Classification Search ..... 81/177.7, 81/177.8, 177.9
See application file for complete search history.

(56) References Cited

U.S. PATENT DOCUMENTS 5,737,982 A * 4/1998 Lin ..... 81/58.3
6,131,490 A * 10/2000 Lee ..... 81/63.1
6,877,404 B2 * 4/2005 Chen ..... 81/177.7
7,171,875 B2 * 2/2007 Hu ..... 81/177.8

* cited by examiner

*Primary Examiner*—Joseph J Hail, III
*Assistant Examiner*—Shantese McDonald
(74) *Attorney, Agent, or Firm*—Banger Shia

(57) ABSTRACT

A hand tool includes a handle having a connection end which includes two parallel arms and a driving member has an insertion which is pivotably connected between the two arms by a pin which extends through the two arms and the engaging notch of the insertion. The driving member can be easily replaced by disengaging the pin from the engaging recess of the driving member.

15 Claims, 18 Drawing Sheets

HAND TOOL WITH REPLACEABLE FUNCTION HEAD

BACKGROUND OF THE INVENTION (1) Field of the Invention

The present invention relates to a hand tool with a replaceable driving member which is easily connected to or removed from the handle.

(2) Description of the Prior Art

A conventional hand tool generally includes a handle and a driving member such as a wrench head or a box end, the driving member usually is integrally connected to the handle and cannot be replaced. Some hand tools have a reception recess defined in the handle so as to receive a pivotable driving member, the reception recess requires a certain space which makes the hand tool difficult to insert into a narrow space. U.S. Pat. No. 7,146,886 discloses a wrench with a replaceable driving member. However, the user has to pull the driving member to check the driving member is well secured or not, and this is not satisfied by the users.

The present invention intends to provide a hand tool with a replaceable driving member, the driving member and the handle are simply hooked to each other by a pin and the driving member can be pivoted about the pin to be operated in different angles.

SUMMARY OF THE INVENTION

The present invention relates to a hand tool which comprises a handle having a connection end which includes two parallel arms and a space is defined between the two arms. A driving member has an insertion which includes an engaging notch defined in an underside thereof. The insertion is located in the space between the two arms and a pin extends through the two arms and the engaging notch of the insertion.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figures 1, 1A:
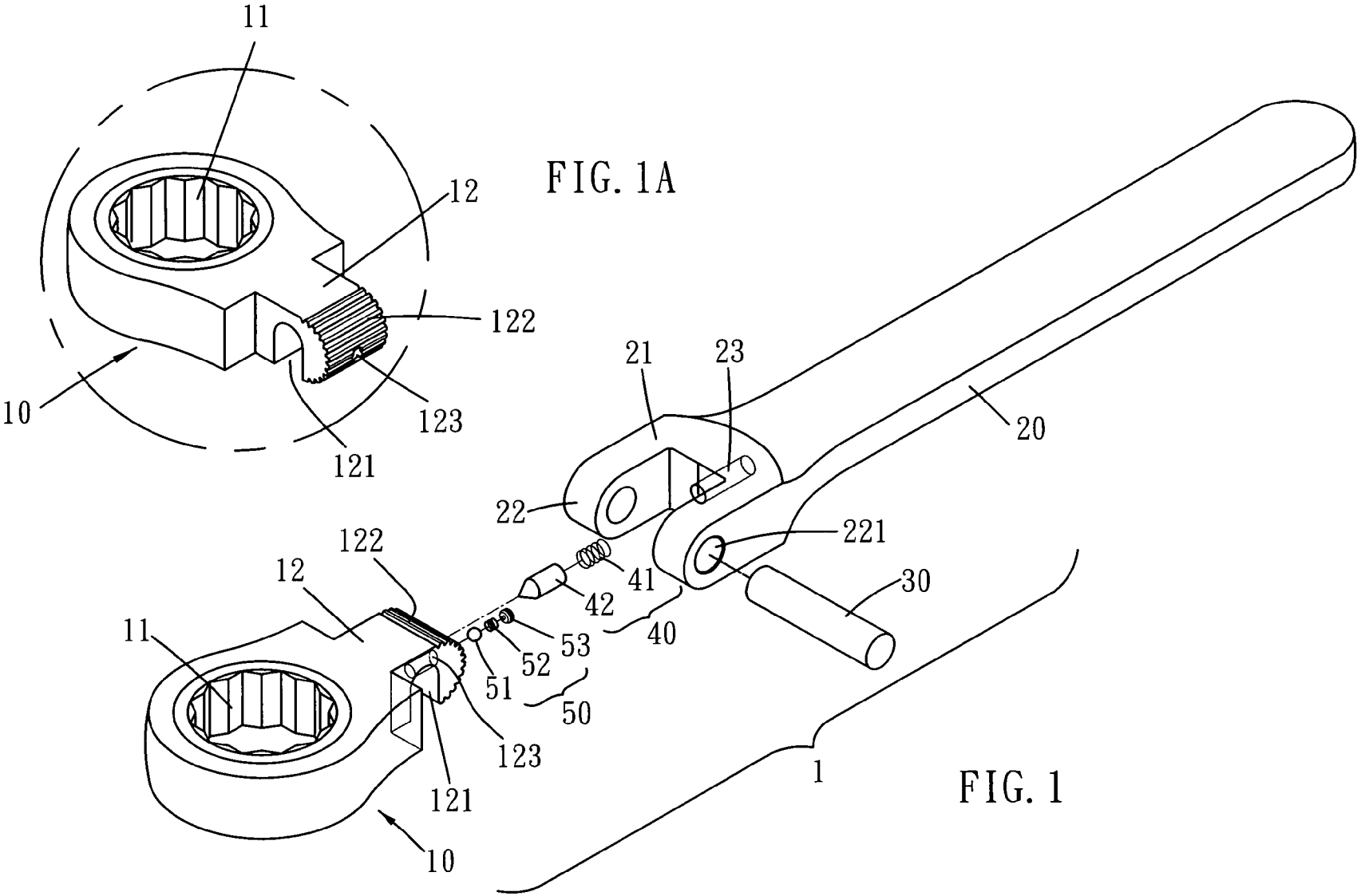
FIG. 1 is an exploded view to show a first embodiment of the hand tool of the present invention.
FIG. 1A is an enlarged view to show the driving member and the engaging notch in the insertion.

Referring to FIGS. 1, 1A, 2, 2A, 3 and 4, the hand tool 1 of the present invention comprises a handle 20 having a connection end 21 which includes two parallel arms 22 and a space defined between the two arms 22. A first recess 23 is defined in an inner end of the space between the two arms 22 and a first engaging unit 40 is received in the first recess 23. The first engaging unit 40 includes a spring 41 and a pawl member 42. A driving member 10 such as a box end which includes a polygonal hole 11 and an insertion 12 extending from the driving member 10. The insertion 12 includes an engaging notch 121 defined in an underside thereof and the insertion 12 is located in the space between the two arms 22. The distal end of the insertion 12 includes teeth 122 defined therein.

A pin 30 extends through two respective through holes 221 in the two arms 22 and the engaging notch 121 of the insertion 12 so that the driving member 10 is pivotably connected between the two arms 22. The pawl member 42 is engaged with one of the teeth 122 to position the driving member 10 at different angles.

Figure 2:
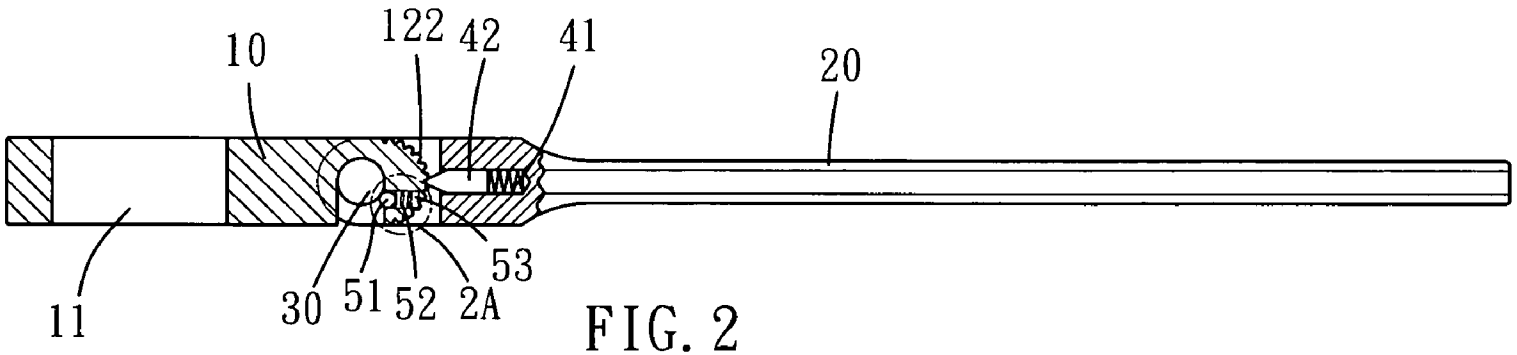
FIG. 2 is a partial side cross sectional view to show the hand tool of the present invention.
Figure 2A:
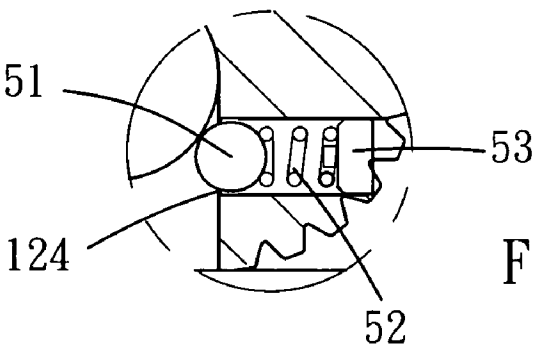
FIG. 2A is an enlarged partial cross sectional view to show the bead is pushed to be in contact with the pin.
Figure 4:
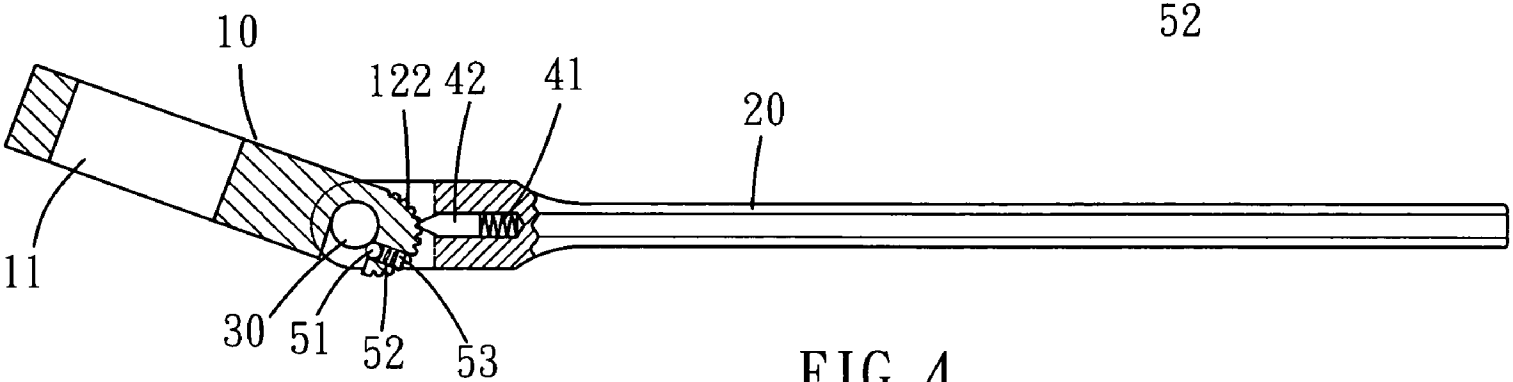
FIG. 4 is a partial side cross sectional view to show the driving member is pivoted relative to the connection end of the hand tool of the present invention.
Figure 3:
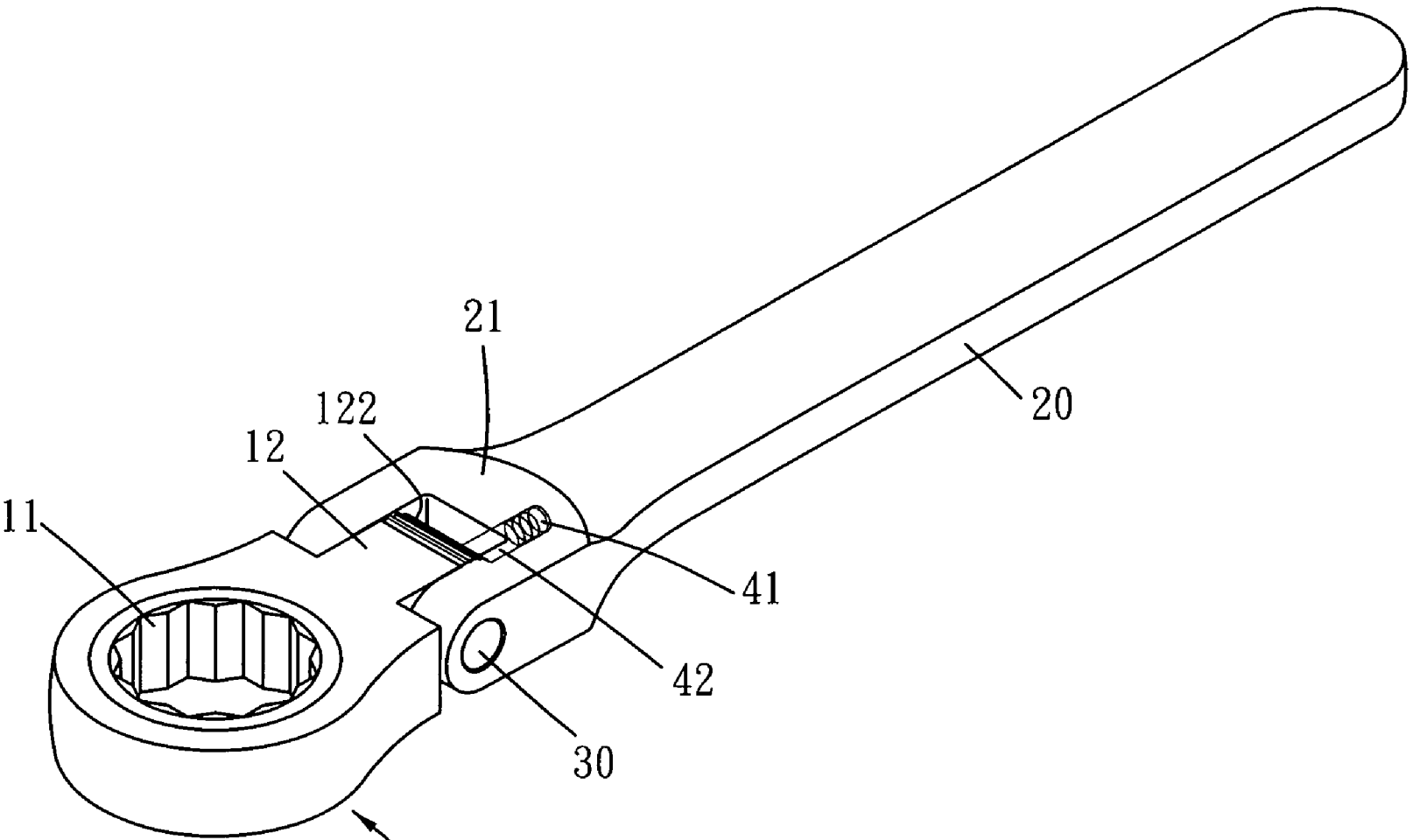
FIG. 3 is a perspective view to show the first embodiment of the hand tool of the present invention.

A passage 123 is defined in a distal end of the insertion 12 and communicates with the engaging notch 121, a second engaging unit 50 is received in the passage 123. The second engaging unit 50 includes a bead 51, a spring 52 which biases the bead 51 toward the engaging notch 121 and a seal member 53 which seals an opening defined by the passage 123 in the distal end of the insertion 12. The bead 51 partially protrudes in the engaging notch 121 and is in contact with the pin 30 as shown in FIG. 2A. A stop 124 extends inward from an inner periphery of the passage 123 so as to stop the bead 51 from disengaging from the passage 123.

Figure 5:
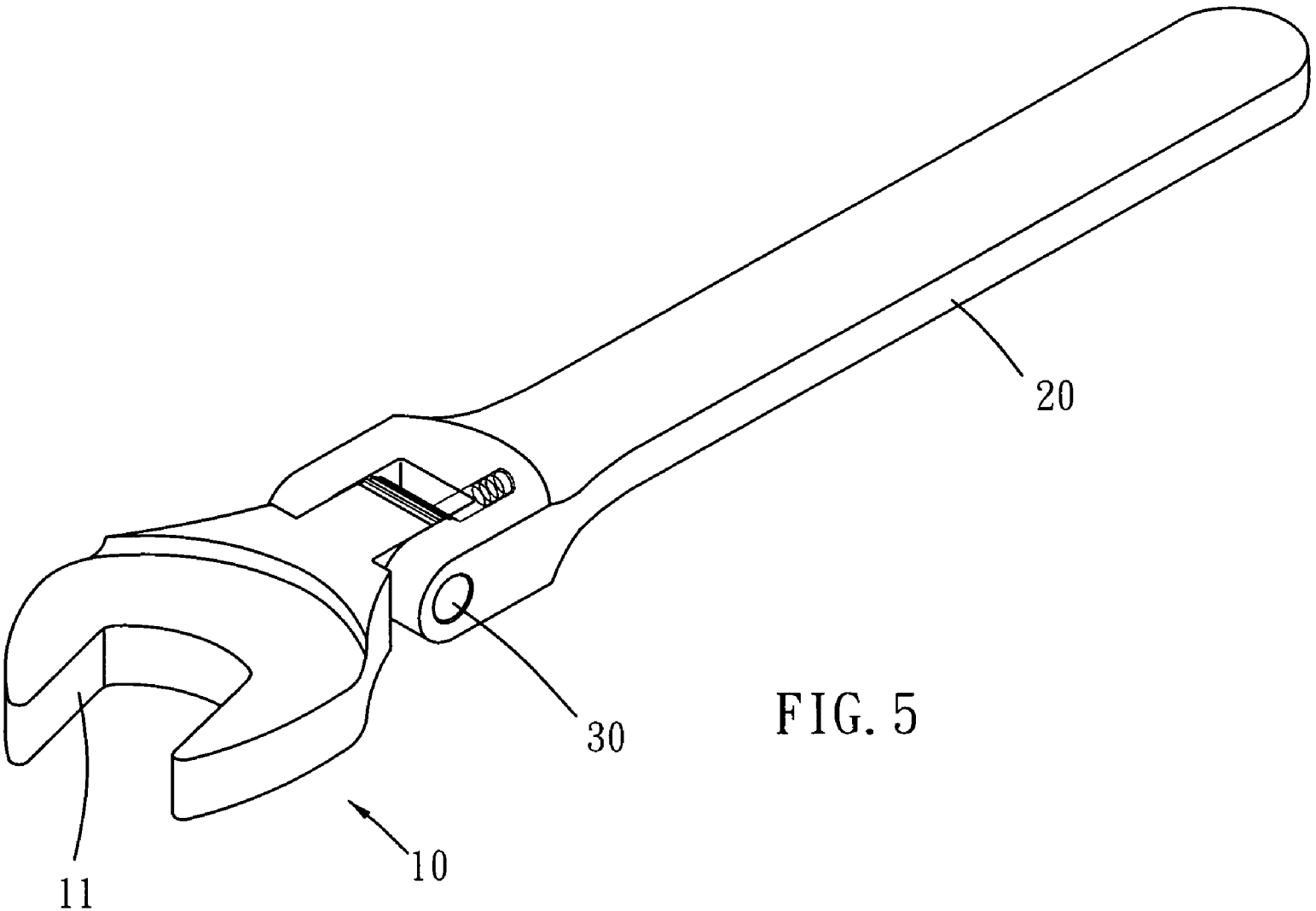
FIG. 5 is a perspective view to show another driving member is connected to the handle of the hand tool of the present invention.
Figures 6, 6A:
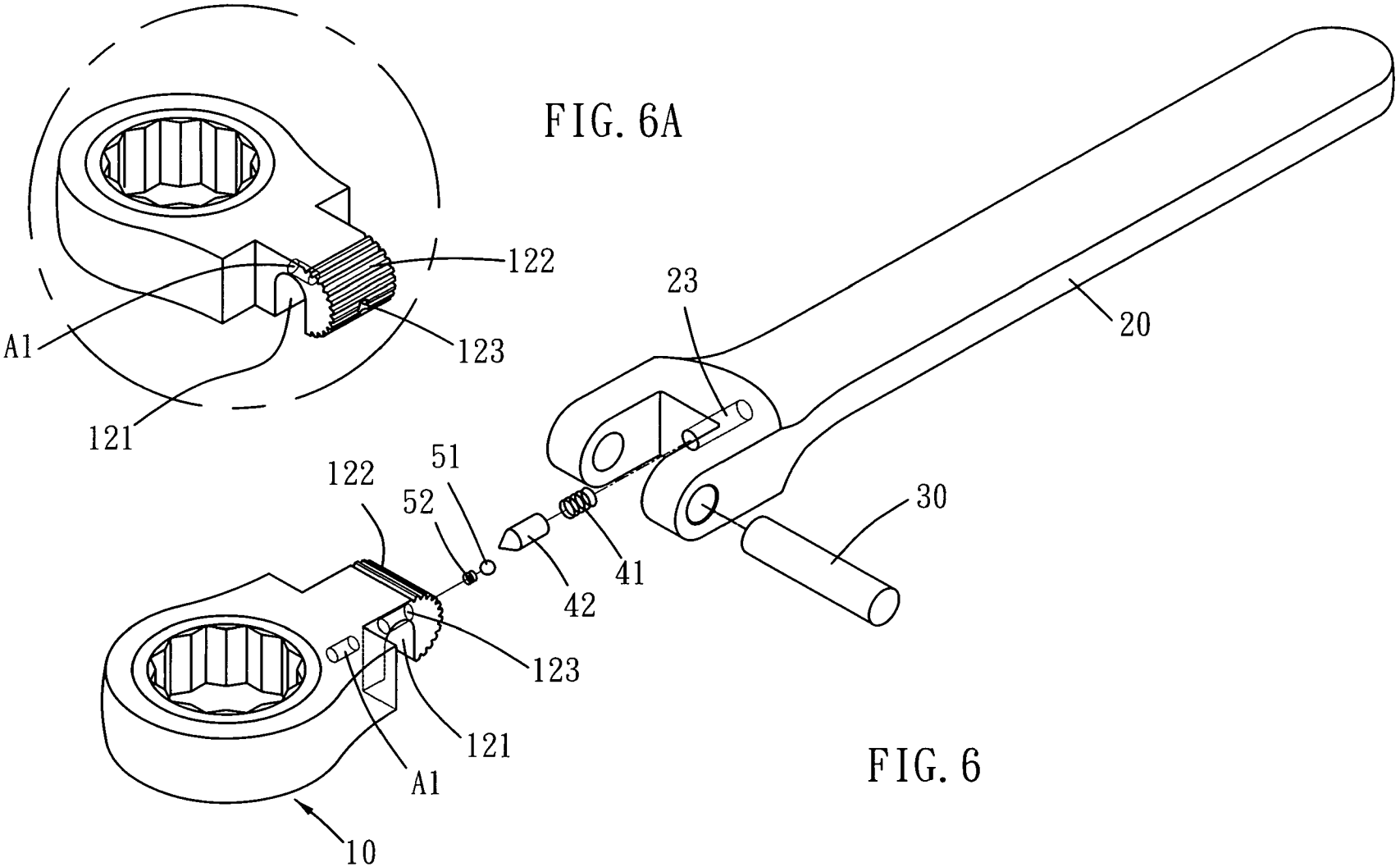
FIG. 6 is an exploded view to show a second embodiment of the hand tool of the present invention.
FIG. 6A is an enlarged view to show the driving member and the engaging notch in the insertion of the second embodiment of the hand tool.
Figure 7:
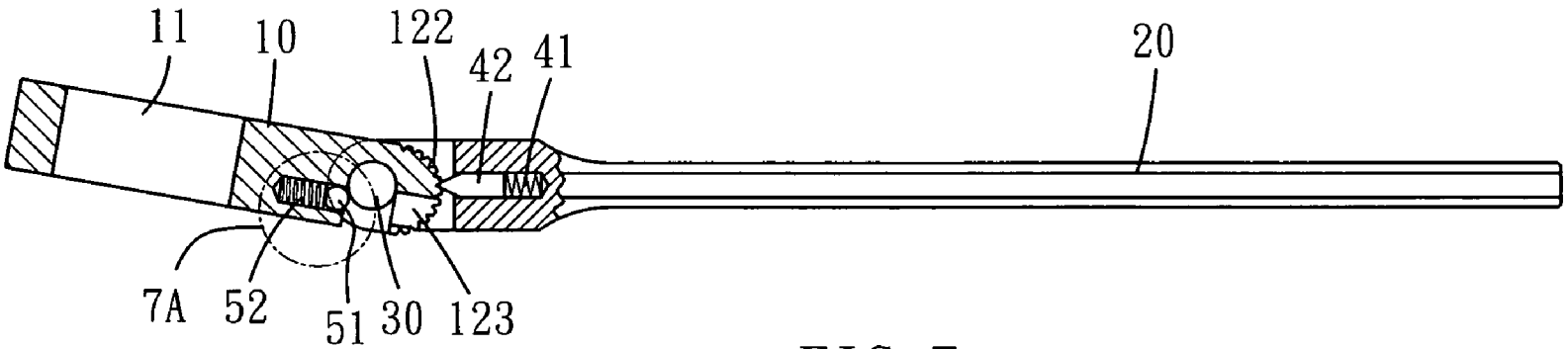
FIG. 7 is a partial side cross sectional view to show the hand tool of the present invention in FIG. 6.
Figure 7A:
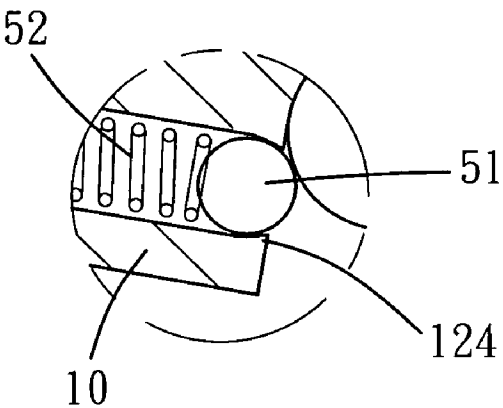
FIG. 7A is an enlarged partial cross sectional view to show the bead is pushed to be in contact with the pin and the bead is stopped by the stop in the second recess.
Figure 8:
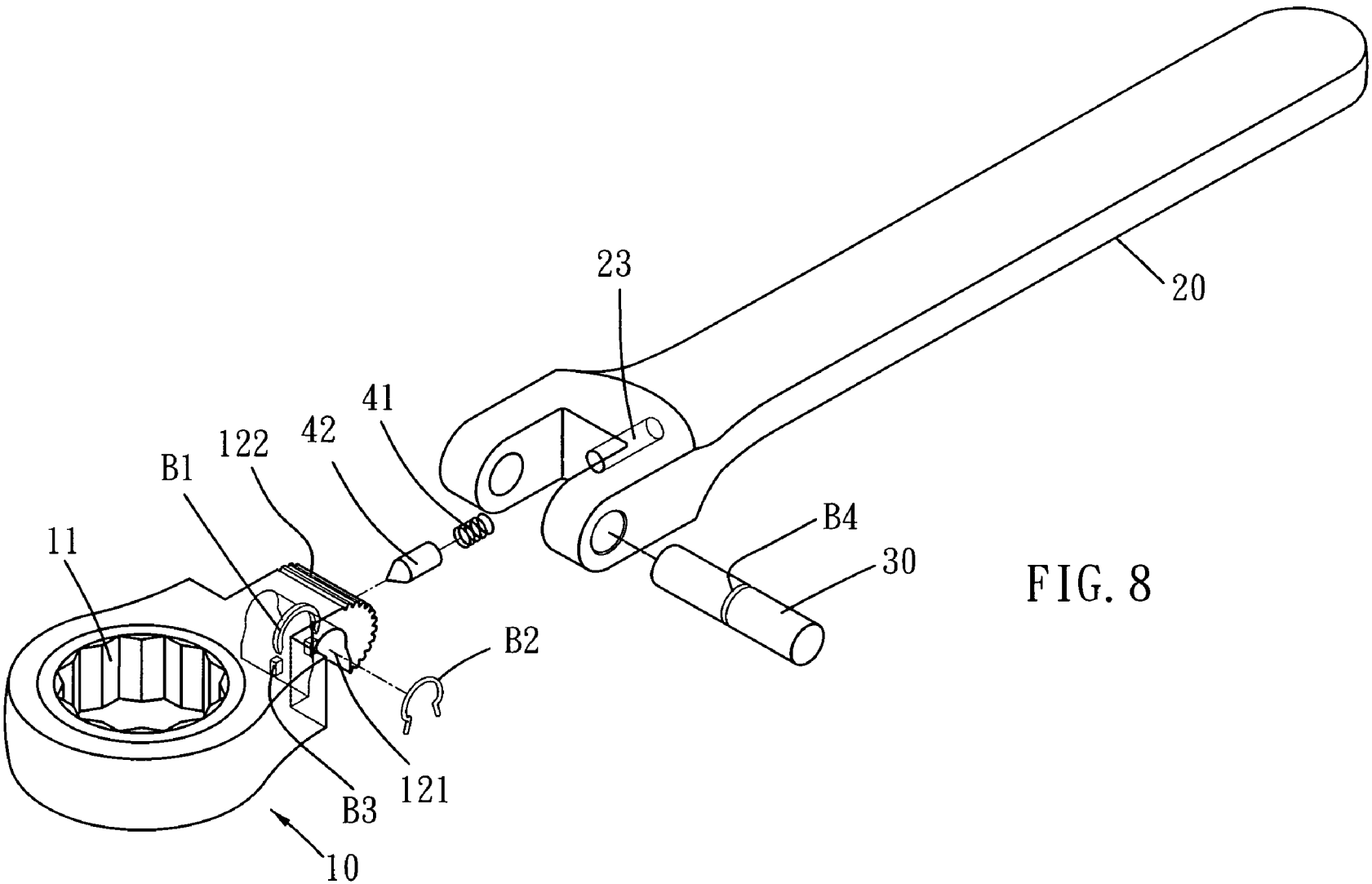
FIG. 8 is an exploded view to show a third embodiment of the hand tool of the present invention.
Figure 9:
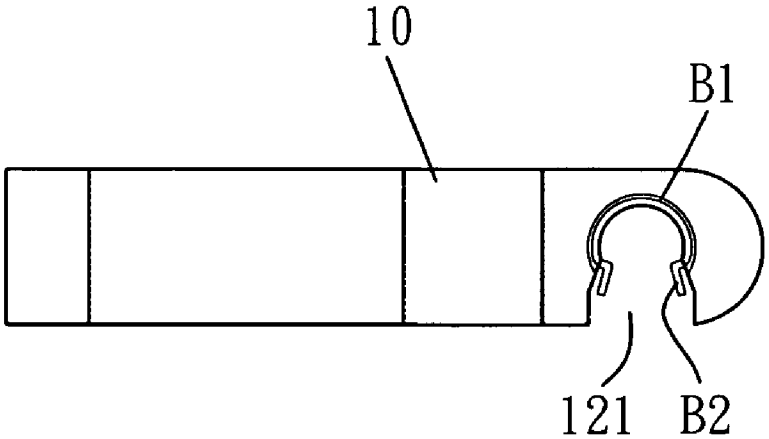
FIG. 9 shows the positions of the two distal ends of the resilient clamp in the third embodiment of the hand tool.
Figure 10:
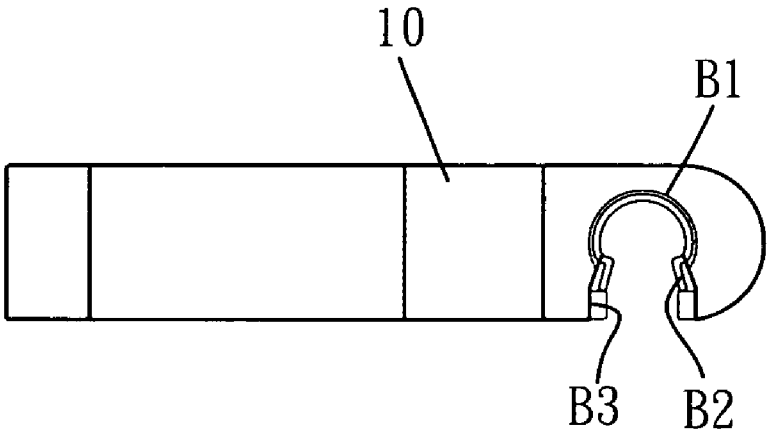
FIG. 10 shows that the two distal ends of the resilient clamp in FIG. 9 are engaged with two blocks.

It is easily to replace another driving member such as the open end wrench head shown in FIG. 5 by applying a force in a first direction to the connection end 21 and applying a force in opposite direction to the driving member 10, the pin 30 is disengaged from the engaging notch 121.

FIGS. 6, 6A, 7 and 7A show a second embodiment of the hand tool 1 wherein a second recess A1 is defined in an inside of the engaging notch 121 and communicates with the engaging notch 121. The second recess A1 is located remote to a distal end of the insertion 12 and located in alignment with the passage 123. A second engaging unit 50 is received in the second recess A1 and includes a bead 51 and a spring 52 which biases the bead 51 toward the engaging notch 121. The bead 51 partially protrudes in the engaging notch 121 and is in contact with the pin 30. A stop 124 extends inward from an inner periphery of the second recess A1 so as to stop the bead 51 from disengaging from the second recess A1.

Figure 11:
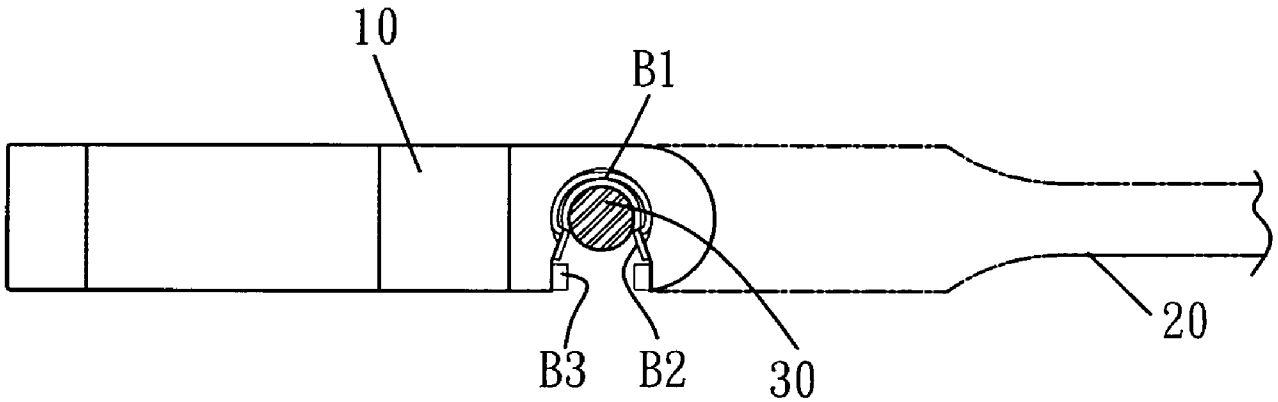
FIG. 11 is a partial cross sectional view to show that the resilient clamp is lifted when mounted on the pin.
Figure 12:
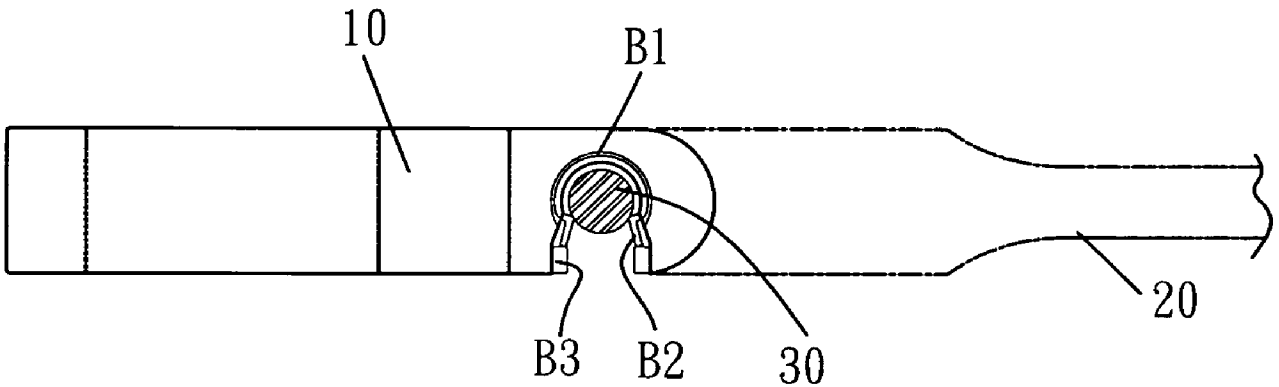
FIG. 12 is a partial cross sectional view to show that the resilient clamp is lowered when engaged with the first groove in the pin.
Figure 13:
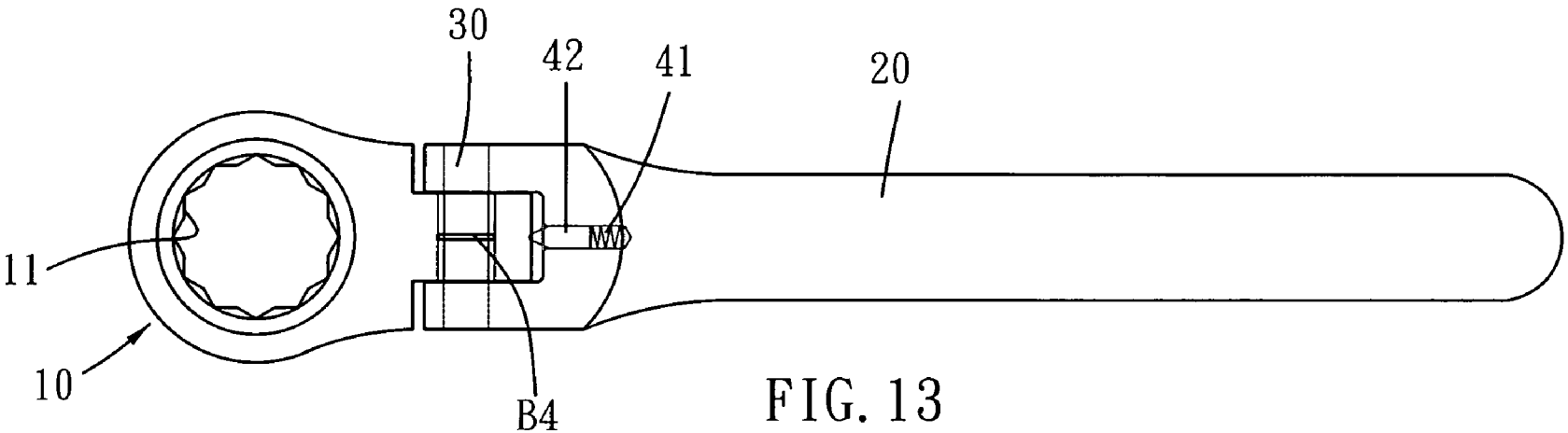
FIG. 13 is a top view to show the hand tool in FIG. 8.
Figure 14:
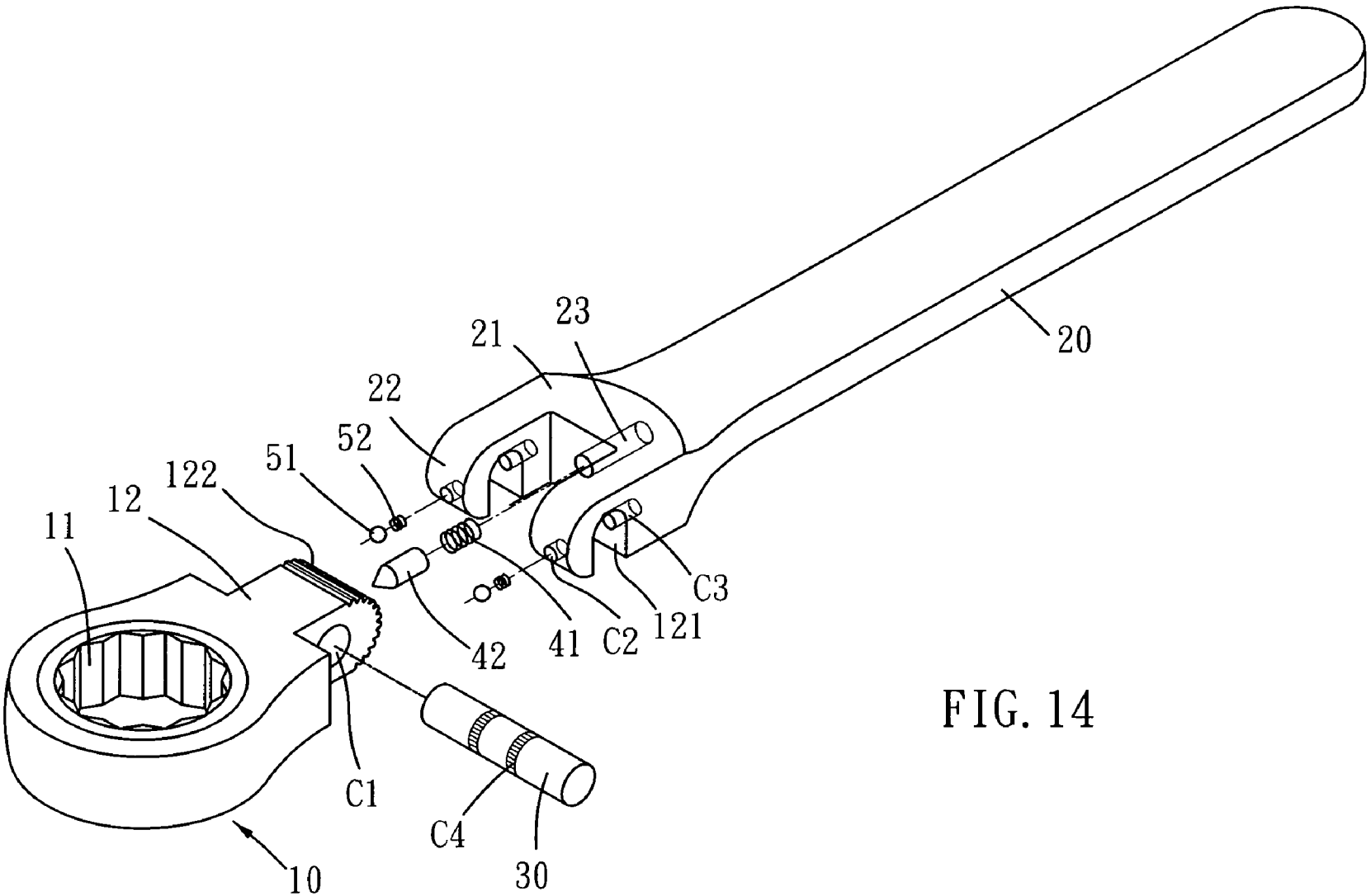
FIG. 14 is an exploded view to show a fourth embodiment of the hand tool of the present invention.
Figure 15:
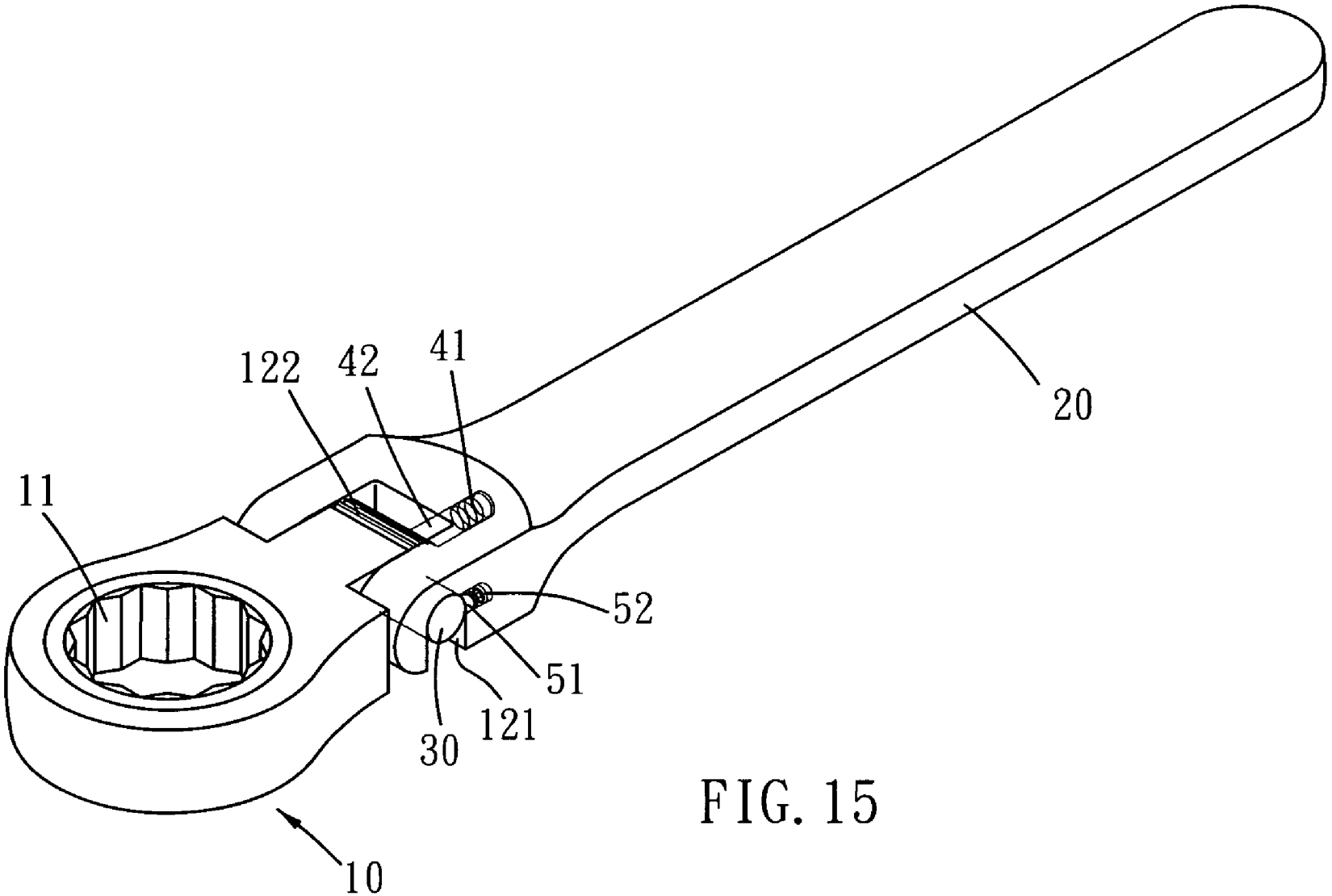
FIG. 15 is a perspective view of the fourth embodiment of the hand tool of the present invention.

FIGS. 8-13 show a third embodiment of the hand tool 1 of the present invention wherein the passage 123 and the second recess A1 are omitted, and a first groove B1 is defined in an inner periphery of the engaging notch 121. A resilient clamp B2 is engaged with the first groove B1. The pin 30 includes a second groove B4 with which the resilient clamp B2 is engaged. The two distal ends of the resilient clamp B2 extend an angle. Two blocks B3 extend from the inner periphery of the engaging notch 121 and are located at two ends of the first groove B1, the two distal ends of the resilient clamp B2 are engaged with the two blocks B3 when the resilient clamp B2 is engaged with the first groove B1. As shown in FIG. 11, when the pin 30 is inserted in the engaging notch 121, the resilient clamp B2 is mounted to the outer periphery of the pin 30 so that the two distal ends of the resilient clamp B2 are lifted, and when the resilient clamp B2 is engaged with the second groove B4 in the outer periphery of the pin 30, the two distal ends of the resilient clamp B2 are lowered and engaged with the two blocks B3.

Figure 16:
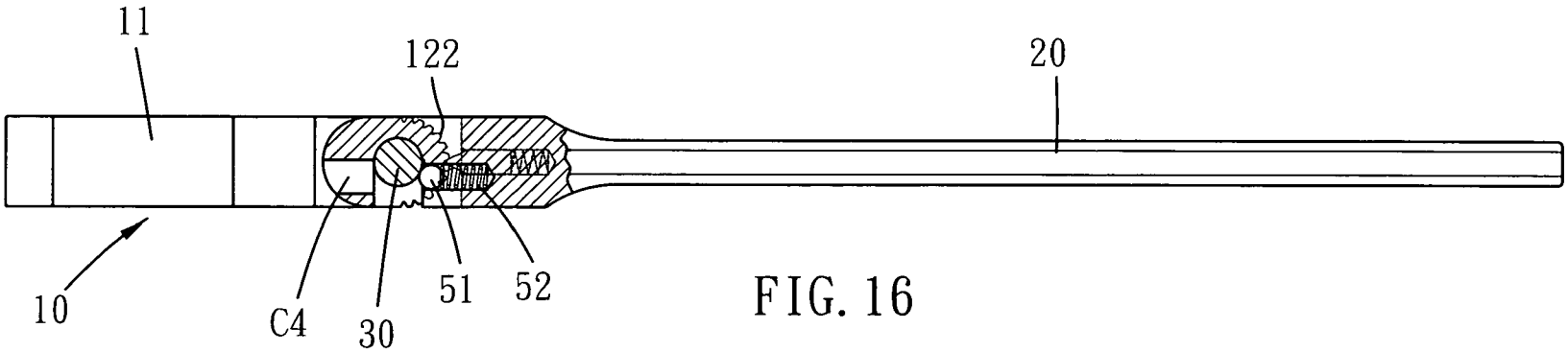
FIG. 16 is a partial side cross sectional view to show the hand tool of the present invention in FIG. 14.
Figure 17:
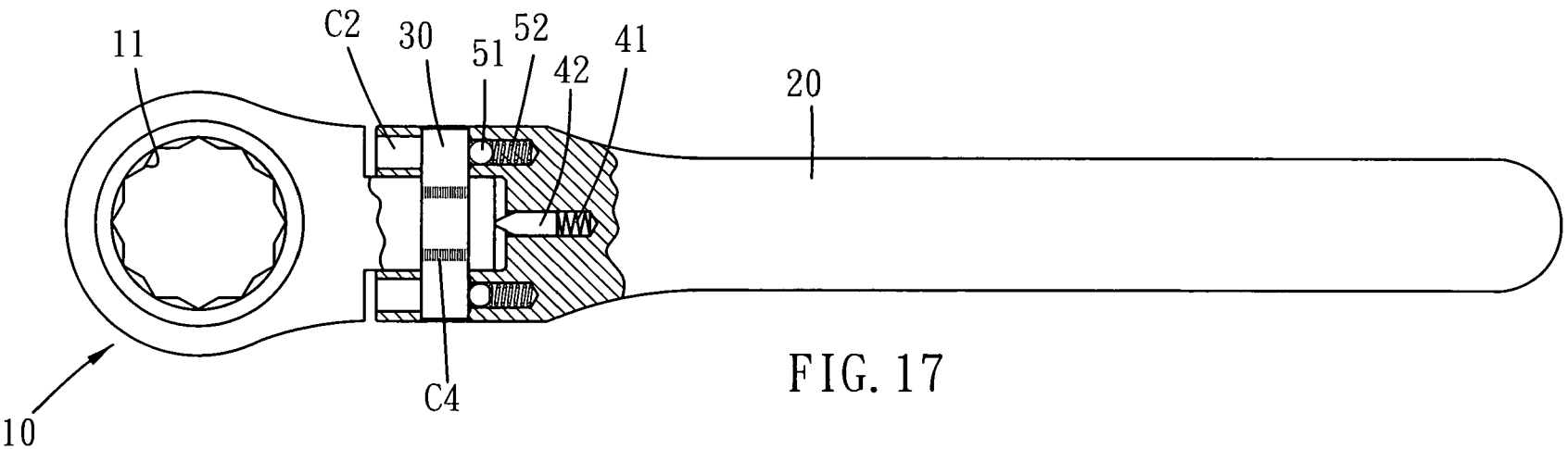
FIG. 17 is a top cross sectional view to show the hand tool of the present invention in FIG. 14.

FIGS. 16-17 show a fourth embodiment of the hand tool 1 and includes a handle 20 having a connection end 21 which includes two parallel arms 22 and a space defined between the two arms 22. Each arm 22 has an engaging notch 121 defined in an underside thereof. A first recess 23 is defined in an inner end of the space between the two arms 22 and a first engaging unit 40 is received in the first recess 23. The first engaging unit 40 includes a spring 41 and a pawl member 42. Two passages C2 are defined in two respective distal ends of the two arms 22 and communicate with the engaging notches 121. Two second recesses C3 are define in two respective inner peripheries of the engaging notches 121 and located remote to the two respective distal ends of the two arms 22. Two second engaging unit 50 are received in the second recesses C3 and each of the second engaging units 50 includes a bead 51 and a spring 52 which biases the bead 51 toward the engaging notch 121, A driving member 10 such as a box end which includes a polygonal hole 11 and an insertion 12 extends from the driving member 10. The insertion 12 is located in the space between the two arms 22 and includes a through hole C1. The distal end of the insertion 12 includes teeth 122 defined therein.

Figure 18:
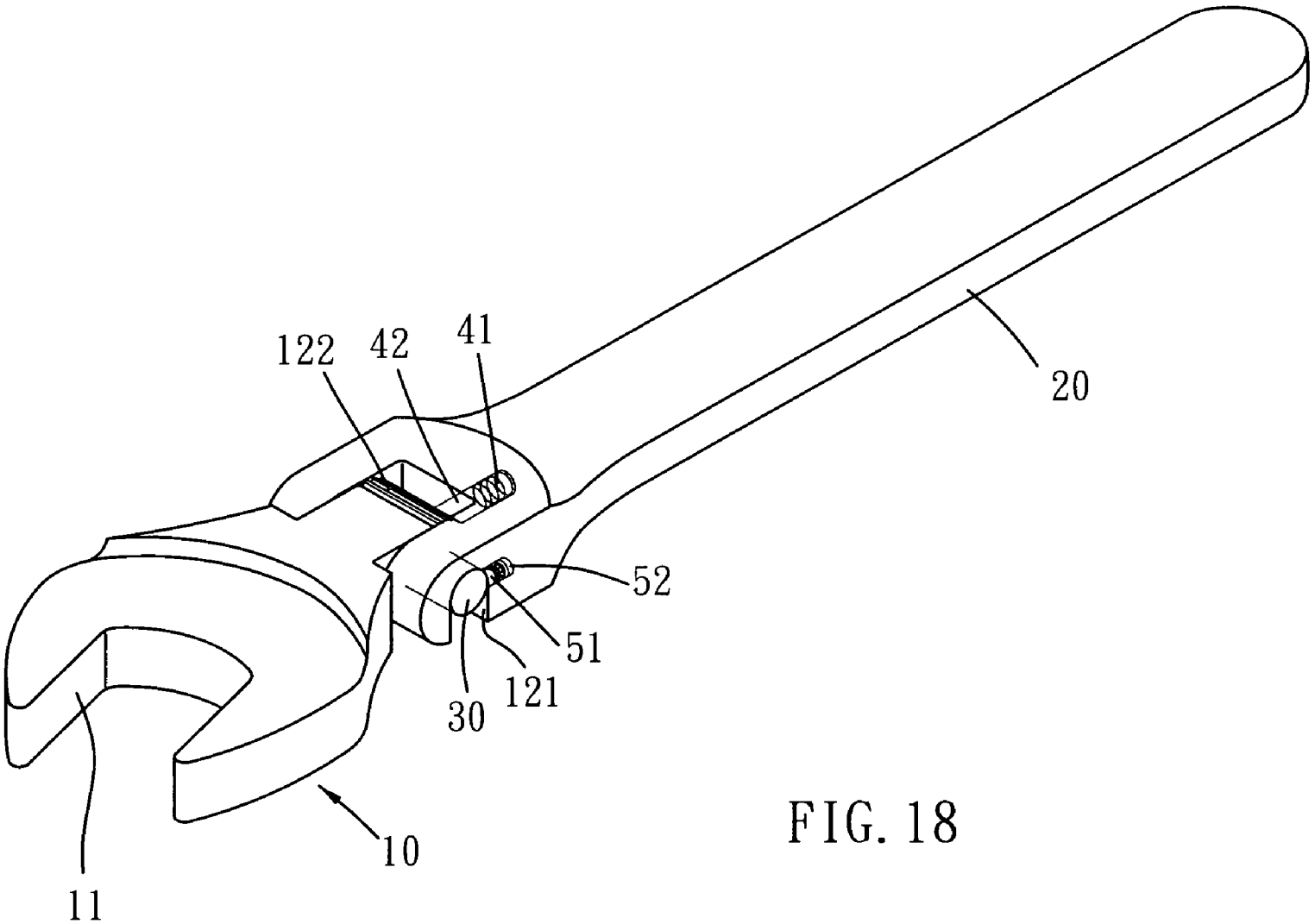
FIG. 18 shows that another driving member is used on the hand tool in FIG. 14.

A pin 30 is engaged with the two engaging notches 121 and extends through the through hole C1 in the insertion 12. The pawl member 42 is engaged with one of the teeth 122. The two beads 51 partially protrude in the engaging notches 121 and are in contact with the pin 30. The pin 30 includes two serrated surfaces C4 defined in an outer periphery thereof and the serrated surfaces C4 are located within the through hole C1 of the insertion 12 so as to increase the friction between the pin 30 and the through hole C1. Another driving member 10 such as an open end wrench head shown in FIG. 18 can be easily connected to the handle 20.

Figure 19:
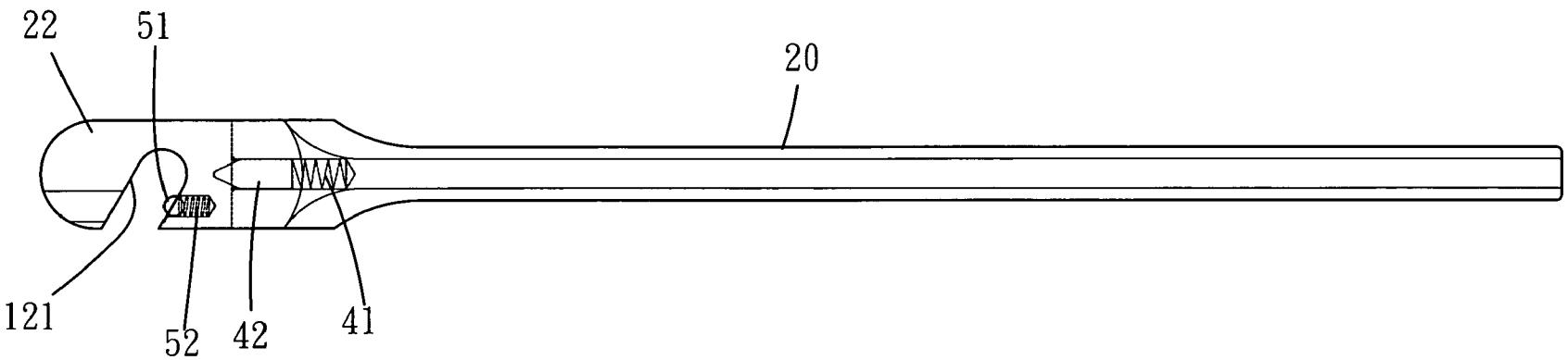
FIG. 19 shows that the engaging notch of in the connection end of the handle is inclined.
Figure 20:
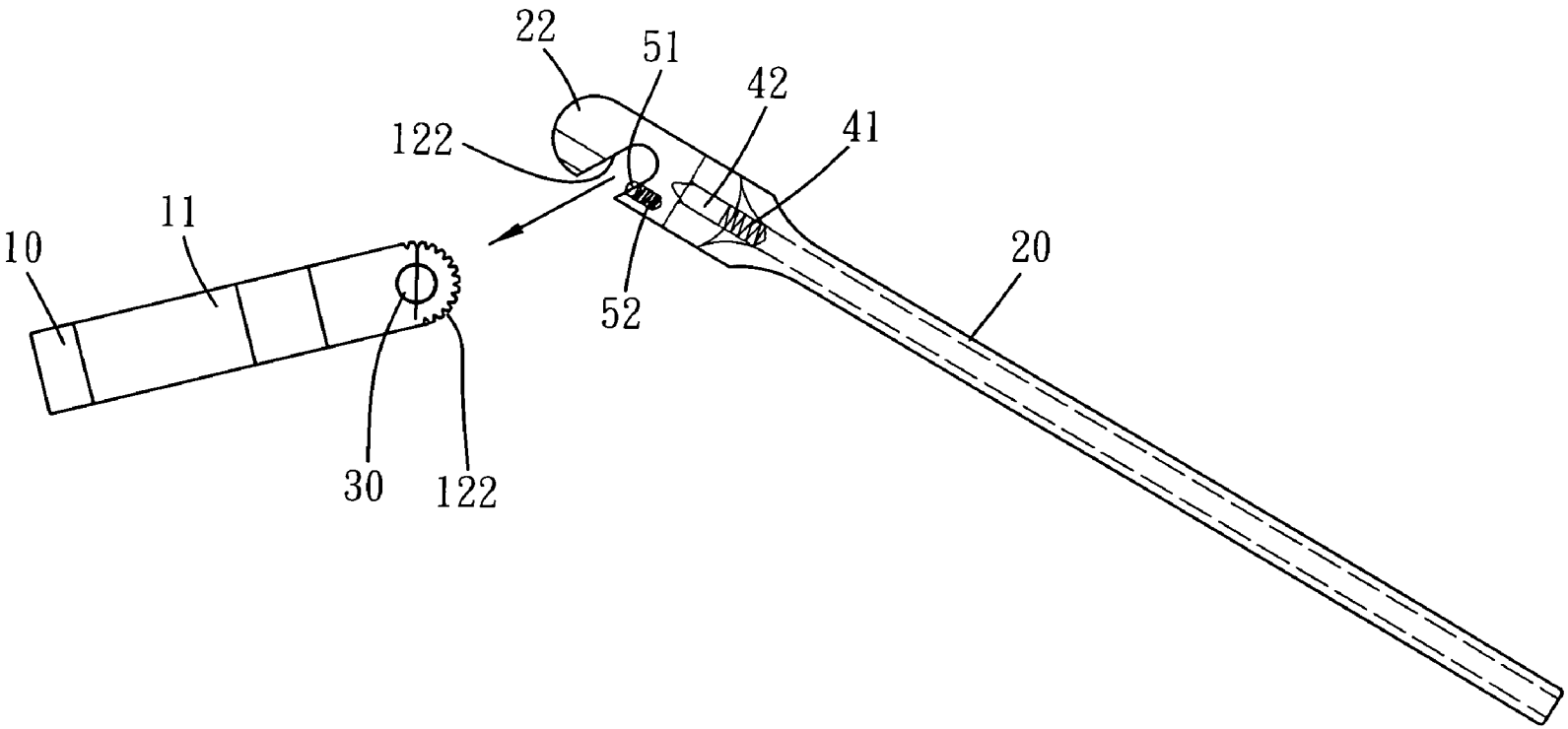
FIG. 20 shows that the inclined engaging notch is convenient to be connected with the pin and the driving member.

FIG. 19 shows that two respective axes of the two engaging notches 121 are inclined relative to an axis of the connection end 21 of the handle 20. As shown in FIG. 20, when a user holds the handle 20 the inclined engaging notches 121 are orientated to be easily engaged with the pin 30.

Figure 21:
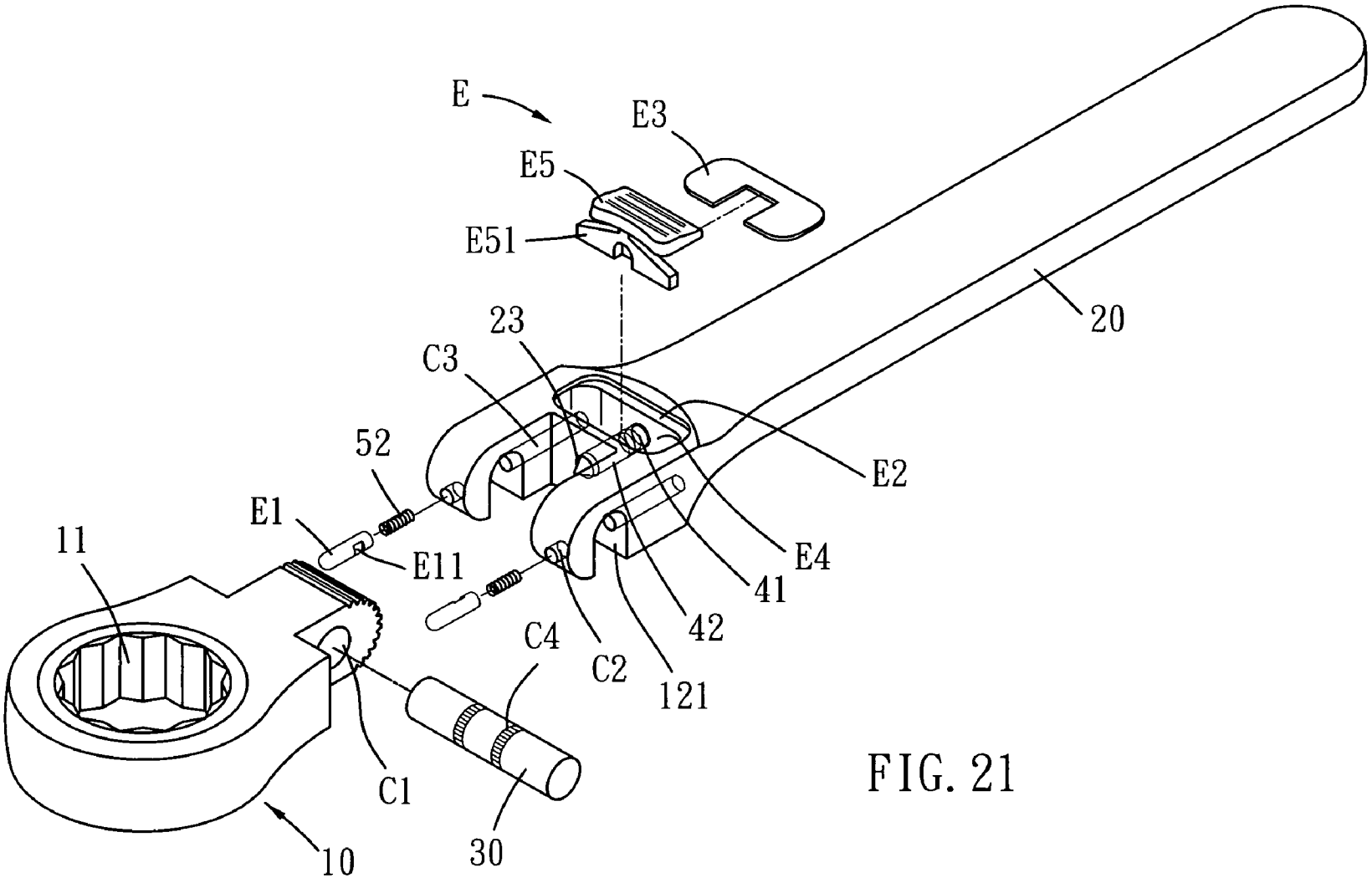
FIG. 21 is an exploded view to show a fifth embodiment of the hand tool of the present invention.
Figure 22:
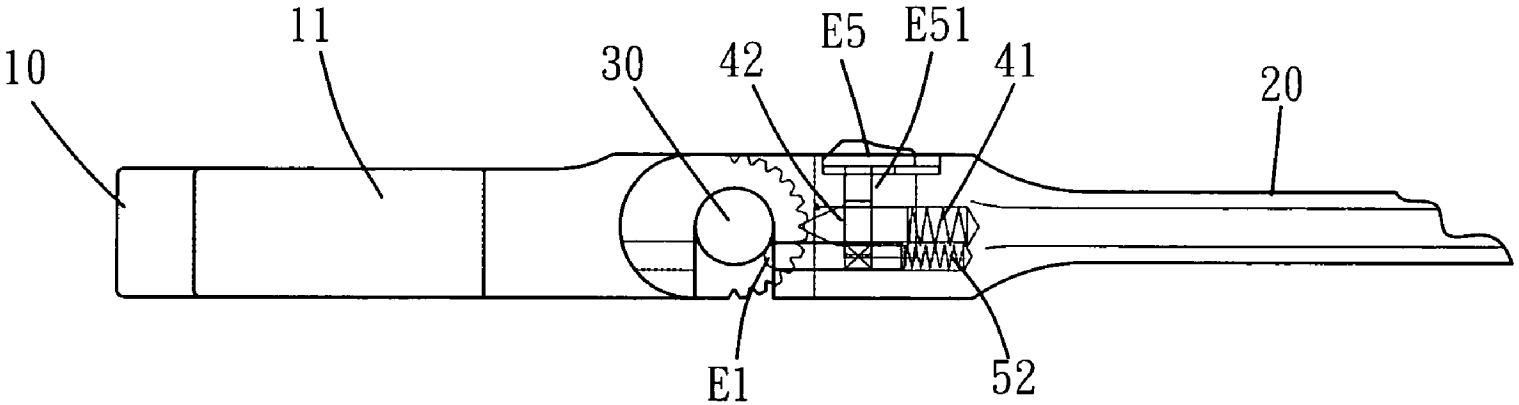
FIG. 22 is a side view to show the fifth embodiment of the hand tool of the present invention wherein the two rods are engaged with the teeth of the driving member.
Figure 23:
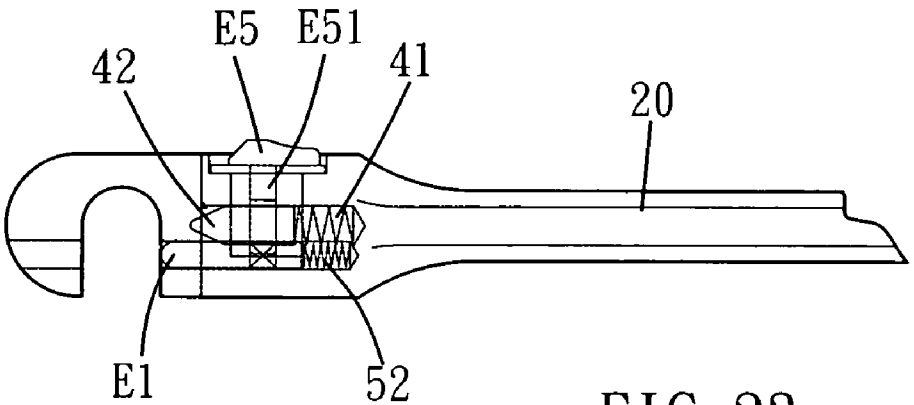
FIG. 23 shows that the two rods are retracted into the second recesses in the handle.

FIGS. 21-23 show a fifth embodiment of the hand tool 1 of the present invention, wherein two passages C2 are defined in two respective distal ends of the two arms 22 and communicate with the engaging notches 121. Two second recesses C3 are defined in two respective inner peripheries of the engaging notches 121 and located remote to the two respective distal ends of the two arms 22. Two third engaging unit 50 are received in the second recesses C3 and each of the second engaging units 50 includes a rod E1 and a spring 52 which biases the bead 51 toward the engaging notch 121. The two rods E1 partially protrude in the engaging recesses 121 and are in contact with the pin 30. A top hole E4 is defined in a top of the connection end 21 and communicates with the first recess 23 and the two second recesses C3. A flange E2 extends inward from an inner periphery of the top hole E4. An operation unit E is engaged with the top hole E4 and includes a horizontal thumb plate E5 and an operation plate E51 which extends perpendicularly from the thumb plate E5. The operation plate E51 includes a recess defined in a lower edge thereof and the pawl member 42 is movably engaged with the recess. The two distal ends of the operation plate E51 are engaged with two respective notches E11 defined in the two rods E1. A cover E3 is connected on the flange E2 and the thumb plate E5 is movably located above the cover E3.

The two rods E1 are retracted into the second recesses C3 when the thumb plate E5 and the operation plate E51 are moved in a direction away from the driving member 10. By this way, the driving member 10 can be easily disconnected from the connection end 21 of the handle 20.

While we have shown and described the embodiment in accordance with the present invention, it should be clear to those skilled in the art that further embodiments may be made without departing from the scope of the present invention.

What is claimed is:

1. A hand tool comprising:

a handle having a connection end which includes two parallel arms and a space defined between the two arms;

a driving member having an insertion which includes an engaging notch defined in an underside thereof, the insertion located in the space between the two arms, and a pin extending through the two arms and the engaging notch of the insertion, wherein the engaging notch having an open end formed on the bottom of the insertion of the driving member for engaging/disengaging the driving member with/from the handle, such that the driving member is replaced easily.

2. The hand tool as claimed in claim 1, wherein a first recess is defined in an inner end of the space between the two arms and a first engaging unit is received in the first recess, the first engaging unit includes a spring and a pawl member which is engaged with a distal end of the insertion of the driving member.

3. The hand tool as claimed in claim 2, wherein the distal end of the insertion includes teeth defined therein and the pawl member is engaged with one of the teeth.

4. The hand tool as claimed in claim 1, wherein a passage is defined in a distal end of the insertion and communicates with the engaging notch, a second engaging unit is received in the passage, the second engaging unit includes a bead, a spring which biases the bead toward the engaging notch and a seal member which seals an opening defined by the passage in the distal end of the insertion, the bead partially protrudes in the engaging recess and is in contact with the pin.

5. The device as claimed in claim 1, wherein a second recess is defined in an inside of the engaging notch and communicates with the engaging notch, the second recess is located remote to a distal end of the insertion and a second engaging unit is received in the second recess, the second engaging unit includes a bead and a spring which biases the bead toward the engaging notch, the bead partially protrudes in the engaging recess and is in contact with the pin, a stop extends inward from an inner periphery of the second recess so as to stop the bead from disengaging from the second recess.

6. The hand tool as claimed in claim 1, wherein a first groove is defined in an inner periphery of the engaging notch and a resilient clamp is engaged with the first groove, the pin includes a second groove with which the resilient clamp is engaged.

7. The hand tool as claimed in claim 6, wherein two blocks extend from the inner periphery of the engaging notch and are located at two ends of the first groove, the resilient clamp includes two distal ends which are engaged with the two blocks when the resilient clamp is engaged with the first groove.

8. A hand tool comprising:

a handle having a connection end which includes two parallel arms and a space defined between the two arms, each arm having an engaging notch defined in an underside thereof, a driving member having an insertion which is located in the space between the two arms and including a through hole, and a pin engaged with the two engaging notches and extending through the through hole in the insertion, wherein the engaging notch having an open end formed on the bottom of the arm of the handle for engaging/disengaging the handle with/from the driving member, such that the driving member is replaced easily.

9. The hand tool as claimed in claim 8, wherein a first recess is defined in an inner end of the space between the two arms and a first engaging unit is received in the first recess, the first engaging unit includes a spring and a pawl member which is engaged with a distal end of the insertion of the driving member.

10. The hand tool as claimed in claim 9, wherein the distal end of the insertion includes teeth defined therein and the pawl member is engaged with one of the teeth.

11. The hand tool as claimed in claim 8, wherein two passages are defined in two respective distal ends of the two arms and communicate with the engaging notches, two second recesses are defined in two respective inner peripheries of the engaging notches and located remote to the two respective distal ends of the two arms, two third engaging unit are received in the second recesses and each of the second engaging units includes a rod and a spring which biases the bead toward the engaging notch, the two rods partially protrude in the engaging recesses and are in contact with the pin, a top hole is defined in a top of the connection end and communicates with the first recess and the two second recesses, a flange extends inward from an inner periphery of the top hole, an operation unit is engaged with the top hole and includes a horizontal thumb plate and an operation plate which extends perpendicularly from the thumb plate, the operation plate includes a recess defined in a lower edge thereof and the pawl member is movably engaged with the recess, the two distal ends of the operation plate are engaged with two respective notches defined in the two rods, a cover is connected on the flange and the thumb plate is movably located above the cover, the two rods are retracted into the second recesses when the thumb plate and the operation plate are moved in a direction away from the driving member.

12. The hand tool as claimed in claim 8, wherein the pin includes two serrated surfaces defined in an outer periphery thereof and the serrated surfaces are located within the through hole of the insertion.

13. A hand tool comprising:

a handle having a connection end which includes two parallel arms and a space defined between the two arms, each arm having an engaging notch defined in an underside thereof, a driving member having an insertion which is located in the space between the two arms and including a through hole, and a pin engaged with the two engaging notches and extending through the through hole in the insertion, wherein the engaging notch having an open end formed on the bottom of the arm of the handle for engaging/disengaging the handle with/from the driving member, such that the driving member is replaced easily, two passages are defined in two respective distal ends of the two arms and communicate with the engaging notches, two second recesses are define in two respective inner peripheries of the engaging notches and located remote to the two respective distal ends of the two arms, two second engaging unit are received in the second recesses and each of the second engaging units includes a bead and a spring which biases the bead toward the engaging notch, the two beads partially protrude in the engaging recesses and are in contact with the pin.

14. The hand tool as claimed in claim 13, wherein the pin includes two serrated surfaces defined in an outer periphery thereof and the serrated surfaces are located within the through hole of the insertion.

15. The hand tool as claimed in claim 13, wherein two respective axes of the two engaging notches are inclined relative to an axis of the connection end of the handle.

* * * * *